US007143606B2

(12) United States Patent
Tranier

(10) Patent No.: US 7,143,606 B2
(45) Date of Patent: Dec. 5, 2006

(54) COMBINED AIR SEPARATION NATURAL GAS LIQUEFACTION PLANT

(75) Inventor: Jean-Pierre Tranier, L'Hay-les-Roses (FR)

(73) Assignee: L'Air Liquide-Societe Anonyme a'Directoire et Conseil de Surveillance pour l'Etide et l'Exploitation des Procedes Georges Claude, Paris (FR)

( * ) Notice: Subject to any disclaimer, the term of this patent is extended or adjusted under 35 U.S.C. 154(b) by 450 days.

(21) Appl. No.: 10/681,632

(22) Filed: Oct. 8, 2003

(65) Prior Publication Data

US 2004/0083756 A1 May 6, 2004

Related U.S. Application Data

(60) Provisional application No. 60/423,039, filed on Nov. 1, 2002.

(51) Int. Cl.
*F25J 1/00* (2006.01)
*F25J 3/00* (2006.01)

(52) U.S. Cl. ..... 62/611; 62/614; 62/643

(58) Field of Classification Search ..... 62/611, 62/612, 614, 643, 646, 644
See application file for complete search history.

(56) References Cited

U.S. PATENT DOCUMENTS

| | | | | |
|---|---|---|---|---|
| 2,909,906 | A * | 10/1959 | Tung et al. | 62/88 |
| 3,339,370 | A * | 9/1967 | Tutton et al. | 62/648 |
| 3,593,535 | A * | 7/1971 | Gaumer et al. | 62/612 |
| 3,763,658 | A | 10/1973 | Gaumer et al. | |
| 3,768,271 | A | 10/1973 | Denis | |
| 3,886,758 | A * | 6/1975 | Perrotin et al. | 62/651 |
| 5,137,558 | A * | 8/1992 | Agrawal | 62/612 |
| 5,220,798 | A * | 6/1993 | Nagamura et al. | 62/656 |
| 5,390,499 | A | 2/1995 | Rhoades et al. | |
| 5,615,561 | A * | 4/1997 | Houshmand et al. | 62/611 |
| 5,768,912 | A | 6/1998 | Dubar | |
| 6,131,407 | A * | 10/2000 | Wissolik | 62/606 |

FOREIGN PATENT DOCUMENTS

| | | | |
|---|---|---|---|
| DE | 199 20 312 | | 11/2000 |
| FR | 2 122 307 | | 9/1972 |
| GB | 2 172 388 | | 9/1986 |
| GB | 2172388 | * | 9/1986 |
| WO | WO 98 36038 | | 8/1998 |
| WO | WO 00 71951 | | 11/2000 |

OTHER PUBLICATIONS

Patent Abstracts of Japan, vol. 2000, No. 8, Oct. 6, 2000 & JP 2000 130926, Osaka Gas Co., Ltd., May 12, 2000.
Finn A. J., et al.: "Developments in natural gas liquefaction" in Hydrocarbon Processing, Gulf Publishing Co., Houston, vol. 78, No. 4, Apr. 1999, pp. 47-50, 53.

* cited by examiner

*Primary Examiner*—William C. Doerrler
(74) *Attorney, Agent, or Firm*—Elwood L. Haynes

(57) ABSTRACT

In an integrated process and apparatus for the separation of air by cryogenic distillation and liquefaction of natural gas in which at least part of the refrigeration required to liquefy the natural gas is derived from at least one cryogenic air distillation plant comprising a main heat exchanger (7) and distillation columns (15, 17), wherein the natural gas (25) liquefies by indirect heat exchange in a heat exchanger (7, 32, 34) with a cold fluid (21, 26), the cold fluid being sent to the heat exchanger at least partially in liquid form and undergoing at least a partial vaporisation in the heat exchanger.

28 Claims, 6 Drawing Sheets

COMBINED AIR SEPARATION NATURAL GAS LIQUEFACTION PLANT

CROSS-REFERENCE TO RELATED APPLICATIONS

This application claims the benefit under 35 U.S.C. § 119(e) to provisional application No. 60/423,039, filed Nov. 1, 2002, the entire contents of which are incorporated herein by reference.

BACKGROUND OF THE INVENTION

Natural gas is often unavailable in regions where consumers are located, making it necessary to move the natural gas from remote areas. Currently, there are four (4) methods for moving the natural gas between locations: transport by pipeline, liquefaction of the light hydrocarbon, conversion of natural gas to a liquid or solid product to allow for transport, and conversion of natural gas to electricity for transport by cable. Each of these methods has its limitations.

Transport by pipeline is a highly popular method for transport. However, this may not be feasible due to the extreme distances between natural gas resources and consumers, which increases cost.

Liquefaction of the light hydrocarbon allows for several different installations and transport. Baseload plants can produce liquefaction of the light hydrocarbon, but are not commonly found. Currently, baseload plants are available at about fifteen (15) sites throughout the world. Each site has at least one train, and each train can carry up to five (5) million tons per year. Methane tankers are another option for transport. Methane tankers can transport a cryogenic liquid at temperatures of about −160° C., but only about one hundred tankers have this capability. Another possibility for liquefaction of the light hydrocarbon is the LNG terminal. At a LNG terminal, the liquefied natural gas from the methane tanker is unloaded, then vaporized and sent to pipelines. A final option for liquefaction is peak-shaving plants. These small liquefaction plants near consumer zones liquefy and store the natural gas when demand is low and vaporize the gas when demand is high.

Converting the natural gas to liquid or solid products, which may easily be transported, is another possibility. The conversion can be done through several methods. The first method, requires that the natural gas be converted to heavy synthetic hydrocarbons in two stages. With the first stage, synthesis gas, an oxygen enriched gas is required to produce a mixture of hydrogen and carbon monoxide by partial oxidation or autothermal reforming. The second stage requires a catalytic reaction, such as the Fischer-Tropsch type. With the second method for converting the natural gas into a liquid or solid product, natural gas is converted into a methanol or used to produce ammonia or fertilizer.

Finally, natural gas can be converted into electricity in cogeneration plants. The electricity is then transported by cable. Similar to transport by pipeline, this is not economical over long distances.

Liquefaction or conversion of the natural gas both require significant investment to make the process profitable. The first synergy between the two processes (liquefaction and conversion) is to be found in the upstream and downstream infrastructures. Upstream if the two units are on the same site, they may use the same gas fields and the same pipeline to transport natural gas to the site. The pretreatment of the natural gas before liquefaction or transformation into synthesis gas can also be common to the two units. The downstream port infrastructures can also be common. The same utilities (water, steam, instrument air) can be common to the two units.

It has been proposed in WO00/71951 to use the energy produced by the vaporization of liquid nitrogen, liquid oxygen or liquid argon to liquefy natural gas. U.S. Pat. No. 5,390,499 and French Patent 2,122,307 concern heat transfer between vaporising liquid nitrogen and liquefying natural gas. UK Patent 2,172,388 describes an air separation unit which produces oxygen and liquid nitrogen. The liquid nitrogen removed from the air separation unit is then transported to a remote site and used to liquefy natural gas. The gaseous nitrogen produced is then used for enhanced oil recovery.

Regarding liquefaction cycles for the production of LNG, several solutions are described in various publications (for example, "Developments in natural gas liquefaction" in Hydrocarbon Processing April 1999). The most efficient is the cascade refrigeration cycle: refrigeration is provided by three different refrigerants, typically methane, ethylene and propane, each been vaporised at several pressure levels. The most used is the mixed refrigerant cycle with propane precooling where a multicomponent mixture of hydrocarbons (typically propane, ethane, methane and/or nitrogen) perform the final cooling of natural gas while a separate propane cycle perform the precooling of natural gas and mixed refrigerant. This cycle is described in U.S. Pat. No. 3,763,658. The last cycle which has never been used in a baseload plant due to its relative high power consumption is the expander cycle. U.S. Pat. No. 5,768,912 shows various possible improvements of such a cycle but none is able to attain the efficiency of the propane precooled mixed refrigerant cycle.

SUMMARY OF THE INVENTION

It is an object of this invention to provide a process to liquefy natural gas in combination with an air separation unit with isentropic expansion and without having such a high power consumption. The invention consists in using the cold that can be generated by the air separation, unit through isentropic expansion preferably together with liquid vaporisation in order to liquefy natural gas. The basic idea consists in using the cold streams removed from the distillation section under liquid or gaseous form, enriched in nitrogen, oxygen or argon in order to cool the natural gas by indirect heat exchange. As the heat for warming those cold streams is no longer fully available to cool down the air, isentropic expansion is used to cool down directly the air. Another solution consists in performing isentropic expansion on one of the cold streams in order to increase the quantity of cooling provided by the cold streams and therefore be able to cool down natural gas and air. Air expansion will be the preferred solution because recycling can be either avoided or minimised. Generally, recycling increases the duty of an heat exchanger therefore increasing its irreversibility.

As used herein, the term "recycling" means that at least in a given section of the heat exchanger, at least a portion of the fluid after expansion is being warmed. In this same given section there is at least a portion of the fluid prior to the expansion. The term "liquefaction" also includes the pseudo-liquefaction which occurs when natural gas is cooled down at a pressure above supercritical pressure.

A process as per the invention will benefit from the following advantages as compared to the cascade or mixed refrigerant cycle or a combination of the two which have been used in all the baseload plants to date:

1. the problem of distributing vapor and liquid phases in the heat exchanger is basically eliminated; therefore, it will be possible to use brazed aluminium heat exchangers which are more efficient and less expensive than classical spiral wound exchangers; they also allow more streams in the heat exchanger;
2. temperature control is much easier when a gas is expanded;
3. start-up/shut-down of the plant is simpler
4. tolerance to variation in composition of the feed is higher;
5. storage of the refrigeration fluids in the cascade cycle or the various components of the mixed refrigerant in order to fill the circuits prior to start-up or to compensate for losses during operation is not anymore required.

According to one embodiment of the invention, there is provided an integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger.

According to further optional embodiments of the invention:

1. isentropic expansion provides the refrigeration for the liquefaction of the natural gas;
2. the air separation unit comprises a double column, with a thermally linked medium pressure column and low pressure column and wherein air is expanded in a turbine before being sent to the medium pressure column;
3. the natural gas is liquefied within the main heat exchanger of a/the cryogenic air distillation plant, in which feed air for the cryogenic air distillation plant is cooled to a temperature suitable for distillation and the cold fluid is at least one liquid stream, enriched in at least one of oxygen, nitrogen and argon with respect to air, which vaporises in the main heat exchanger;
4. all the air to be separated in the cryogenic air distillation plant is cooled in the main heat exchanger;
5. the natural gas is liquefied by heat exchange in an additional heat exchanger other than the main heat exchanger with at least one cold fluid which has previously been cooled by a vaporising liquid in the main heat exchanger of at least one air distillation plant;
6. the natural gas is liquefied by means of a dosed circuit in which a cold fluid flows, said cold fluid being warmed by heat exchange with the liquefying vaporising natural gas and cooled by heat exchange in the main heat exchanger;
7. the cold fluid is chosen from the group comprising nitrogen, argon, CF4, HCF3, methane, ethane, ethylene and propane;
8. gaseous nitrogen from the cryogenic air distillation plant is sent to the additional heat exchanger;
9. the cryogenic air distillation plant produces pressurised oxygen for at least one of a GTL plant, a methanol plant or a DME plant fed by natural gas;
10. all of the refrigeration required to liquefy the natural gas is derived from a single cryogenic air distillation plant, the columns of the plant, the main heat exchanger and the further heat exchanger being situated within a single cold box;
11. part of the refrigeration required to liquefy the natural gas is derived from at least two cryogenic air distillation plants, each comprising a main heat exchanger and distillation columns, said main heat exchanger and distillation columns being within the cold box, the part of the refrigeration required to liquefy the natural gas being produced by vaporisation of at least one liquid stream, enriched in oxygen, nitrogen or argon, produced by one of the distillation columns, and the natural gas liquefies by heat exchange in a further heat exchanger by heat exchange with a cold fluid removed from each cryogenic air distillation plant;
12. the natural gas prior to undergoing indirect heat exchange with said cold fluid is at least partially precooled at a temperature below 0° C. by indirect heat exchange with at least one fluid not derived from any cryogenic air distillation plant;
13. said fluid(s) not derived from any cryogenic air distillation plant comprises propane.

According to a further embodiment of the invention there is provided integrated apparatus for the separation of air by cryogenic distillation and liquefaction of natural gas in which at least part of the refrigeration required to liquefy the natural gas is derived from at least one cryogenic air distillation plant comprising a main heat exchanger and distillation columns, comprising means for sending natural gas and a cold fluid at least partially in liquid form to a heat exchanger, means for removing liquefied natural gas from the heat exchanger and means for removing at least partially vaporised cold fluid from the heat exchanger.

According to further optional embodiments related to the apparatus features of the invention:

1. isentropic expansion provides the refrigeration for the liquefaction of the natural gas;
2. the air separation unit comprises a double column, with a thermally linked medium pressure column and low pressure column and a turbine in which air is expanded and means for sending the expanded air to the medium pressure column;
3. the apparatus comprises means for sending the natural gas to be liquefied to the main heat exchanger of a/the cryogenic air distillation plant, and wherein the cold fluid is at least one liquid stream, enriched in at least one of oxygen, nitrogen and argon with respect to air, which vaporises in the main heat exchanger,
4. the apparatus comprises means for sending all the air to be separated to the main heat exchanger;
5. the apparatus comprises an additional heat exchanger other than the main heat exchanger and means for sending the natural gas to be liquefied and at least one cold fluid which has previously been cooled by a vaporising liquid in the main heat exchanger of at least one air distillation plant to the additional heat exchanger;
6. the apparatus comprises a closed circuit passing through the main and additional heat exchangers in which the at least one cold fluid flows;
7. the apparatus comprises means for sending gaseous nitrogen from the at least one cryogenic air distillation plant to the additional heat exchanger;
8. the apparatus comprises means for sending pressurised oxygen from the cryogenic air distillation plant to at least one of a GTL, methanol and DME plant fed by natural gas;

9. all of the refrigeration required to liquefy the natural gas is derived from a single cryogenic air distillation plant, the columns of the plant, the main heat exchanger and the further heat exchanger being situated within a single cold box;
10. part of the refrigeration required to liquefy the natural gas is derived from at least two cryogenic air distillation plants, each comprising a main heat exchanger and distillation columns, said main heat exchanger and distillation columns being within the cold box, the part of the refrigeration required to liquefy the natural gas being produced by vaporisation of at least one liquid stream, enriched in oxygen, nitrogen or argon, produced by one of the distillation columns, and the natural gas liquefies by heat exchange in a further heat exchanger by heat exchange with a cold fluid removed from each cryogenic air distillation plant;
11. the apparatus comprises means for precooling the natural gas prior to undergoing indirect heat exchange with said cold fluid;
12. said means for precooling comprises a heat exchanger and means for sending propane to the heat exchanger.

DETAILED DESCRIPTION OF THE INVENTION

Figure 1:
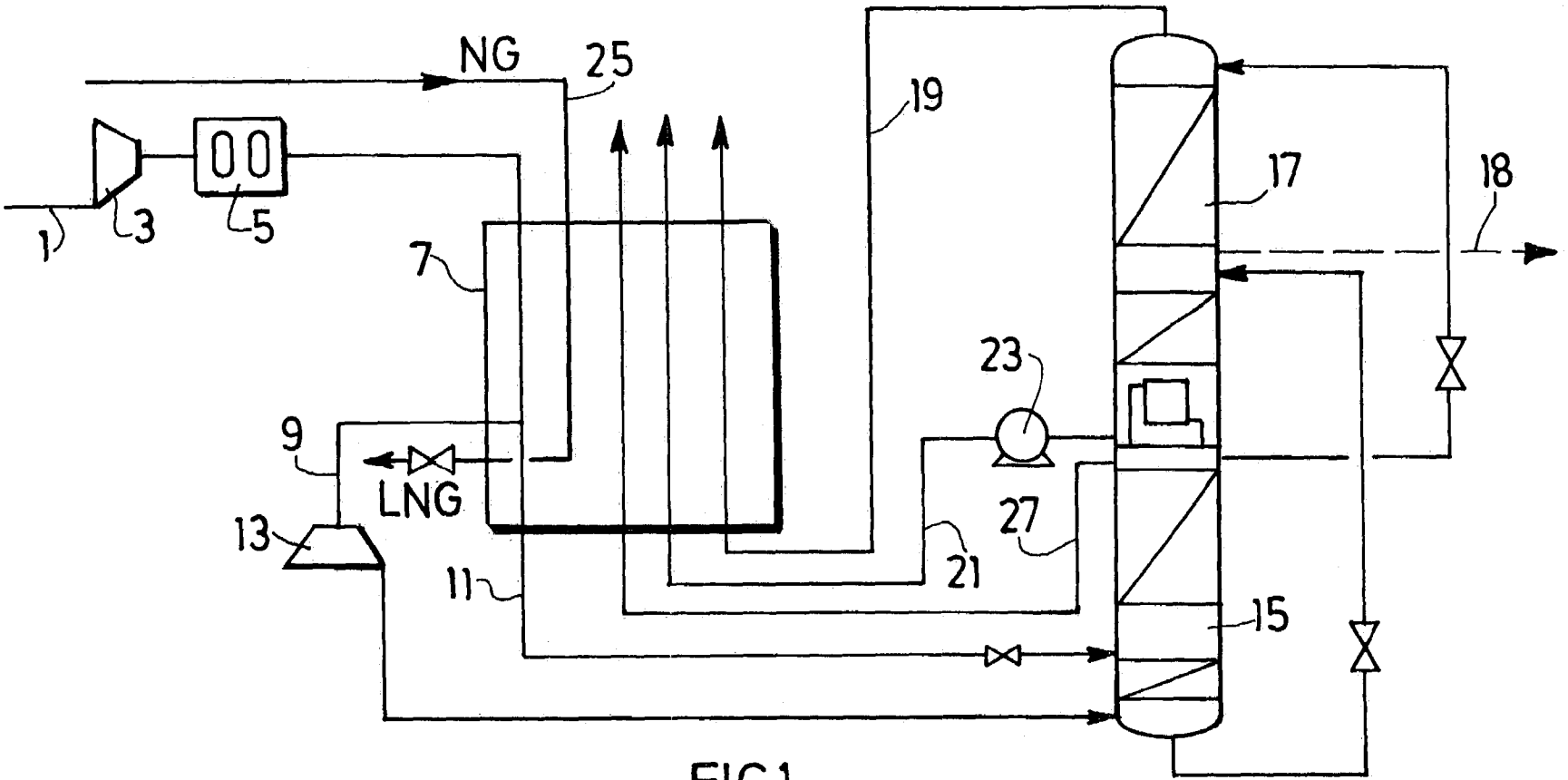
FIGS. 1 to 5 are schematic diagrams of installations according to the invention.

Several embodiments of the invention are possible:

Minimal LNG production using the installation of FIG. 1. In this case, the GTL plant is typically constructed near an existing/future LNG baseload plant in order to benefit from its infrastructures.

Air 1 is compressed in a main air compressor 3 to a pressure of 21.5 bar. and is cooled through the use of a mechanical refrigeration unit or an absorption refrigeration unit to a temperature of 12° C. Air 1 is then purified through adsorbers 5 containing typically and molecular sieve and impurities like water and $CO_2$ are removed. A low temperature for the purification unit is preferred for several reasons air will enter the main heat exchanger at a lower temperature allowing an increase in the LNG production, air will content less water and adsorption is more efficient therefore less alumina and molecular sieve will be required. Air 1 (base=1000 $Nm^3/h$) is then introduced in a main heat exchanger 7 typically of the plate-fin brazed aluminium type (alternately a spiral wound exchanger may be used) and is cooled to a temperature of −145° C. and split in two streams 9, 11: first stream 9 (848 $Nm^3/h$) is expanded through an expansion turbine 13 to a pressure of 5.6 bar, a temperature of −173.5° C. and a liquid fraction of more than 10%. It has been assumed that the energy resuffing from this expansion is recovered in a generator. Nevertheless, several other alternates are available such as:

braking the turbine by a booster prior to or after the purification unit allowing a reduction in the discharge pressure of the main air compressor; or transferring the power of the expansion turbine to the shaft of the main air compressor orbits driver either directly or through a gear.

Second stream 11 (152 $Nm^3/h$) is further cooled, condensed and subcooled to a temperature of −174.8° C. Both streams are introduced into the medium pressure column 15 of the cryogenic air separation plant. Oxygen enriched and nitrogen enriched streams are removed from the medium pressure column 15 and sent to the low pressure column 17. From this distillation column 17, a liquid oxygen enriched stream 21 (200 $Nm^3/h$) is removed and pumped by pump 23 to a pressure of 53.5 bar; two gaseous nitrogen enriched streams 19, 27 are also removed, on 19 from the low pressure column 17 at low pressure 1.25 bar abs. and a temperature of −176° C. (this stream has been used to subcool streams internal to the distillation section; flow: 720 $Nm^3/h$), another 27 from the medium pressure column 15 at medium pressure 5.5 bar abs. and −177.8° C. (flow 80 $Nm^3/h$). Those three streams 19, 21, 27 are warmed in the heat exchanger 7. A pre-treated natural gas stream GN 25 (from which Hg, $H_2S$, $H_2O$ and $CO_2$ have been removed) at a pressure of 60 bar abs. and a temperature close to ambient is introduced into warm end of the heat exchanger 7 with a flow of 38 $Nm^3/h$. If stream 25 contains heavy hydrocarbons, it can be removed at an intermediate temperature of the exchanger 7 to remove those heavy hydrocarbons as shown in U.S. Pat. No. 5,390,499 and then reintroduced in the heat exchanger 7 to be further cooled to a temperature of around −165° C. and sent to storage after expansion through a valve or a liquid turbine as flow GNL. The liquefied natural gas is removed from the heat exchanger 7 at a point upstream of the point at which air stream 9 is removed therefrom.

Figure 2:
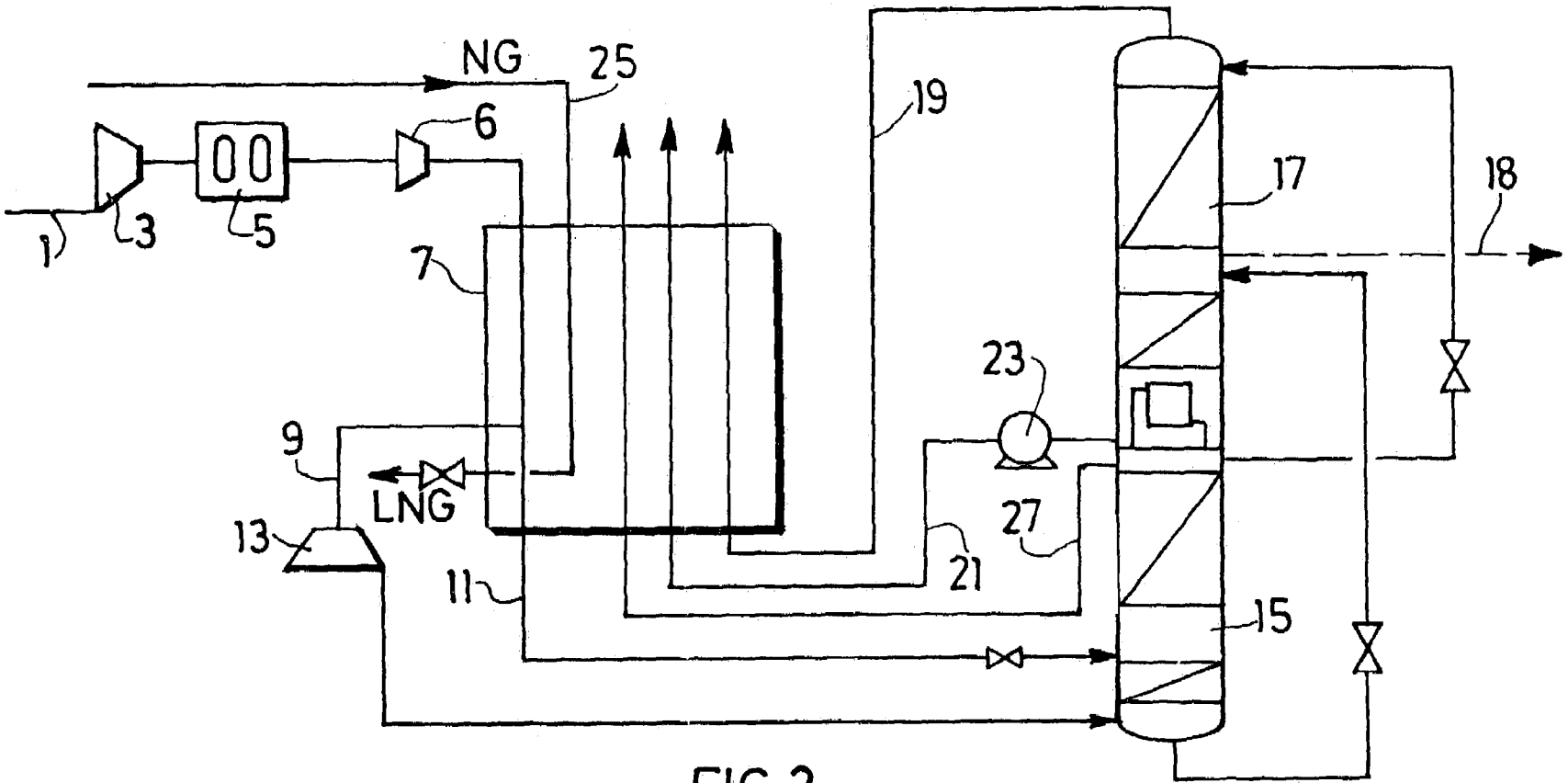

Intermediate liquid production using the installation of FIG. 2. Air 1 is compressed by compressor 3 to an intermediate pressure preferably between 5 and 25 bar abs, typically around 15 bar abs and is cooled through the use of a mechanical refrigeration unit or an absorption refrigeration unit to a temperature of 12° C. Air is then purified through adsorbers 5 containing typically alumina and molecular sieve and impurities like water and $CO_2$ are removed. Air (base=1000 $Nm^3/h$) is further compressed in a booster 6 to a pressure of 50 bar abs., cooled and then introduced in an heat exchanger 7 typically of the plate-fin brazed aluminium type (alternately a spiral wound exchanger may be used) and is cooled to a temperature of −77° C. and split in two streams: first stream 9 (708 $Nm^3/h$) is expanded through an expansion turbine 13 to a pressure of 5.6 bar, a temperature of −163.7° C. Second stream 11 (292 $Nm^3/h$) is further cooled, condensed and subcooled to a temperature of −174.4° C. Both streams are introduced into the medium pressure column 15 of the cryogenic air separation plant. Oxygen enriched and nitrogen enriched streams are removed from the medium pressure column 15 and sent to the low pressure column 17. From this distillation column 17, a liquid oxygen enriched stream 21 (200 $Nm^3/h$) is removed and pumped to a pressure of 53.5 bar, two gaseous nitrogen enriched streams 19, 27 are also removed, one 19 at low pressure 1.25 bar and a temperature of −175.4° C. (this stream has been used to subcool streams internal to the distillation section; flow: 720 $Nm^3/h$), another 27 at medium pressure 5.5 bar and −177.8° C. (flow 80 $Nm^3/h$). Those three streams are warmed in the heat exchanger and oxygen 21 is vaporized. A pre-treated natural gas stream 25 GN (from which Hg, $H_2S$, $H_2O$, $CO_2$ and any other impurity which may solidify have been removed) at a pressure of 60 bar abs. is precooled to a temperature of −38° C. (typically using a propane cycle like that described in U.S. Pat. No. 3,763,658) is introduced in the heat exchanger 7. The flow of natural gas is 134 $Nm^3/h$. Heavy hydrocarbons have been removed during this precooling phase. It is then introduced in the heat exchanger 7 to be further cooled to a temperature around −165° C. and send to storage after expansion through a valve or a liquid turbine, upstream of turbine 13.

Figure 3:
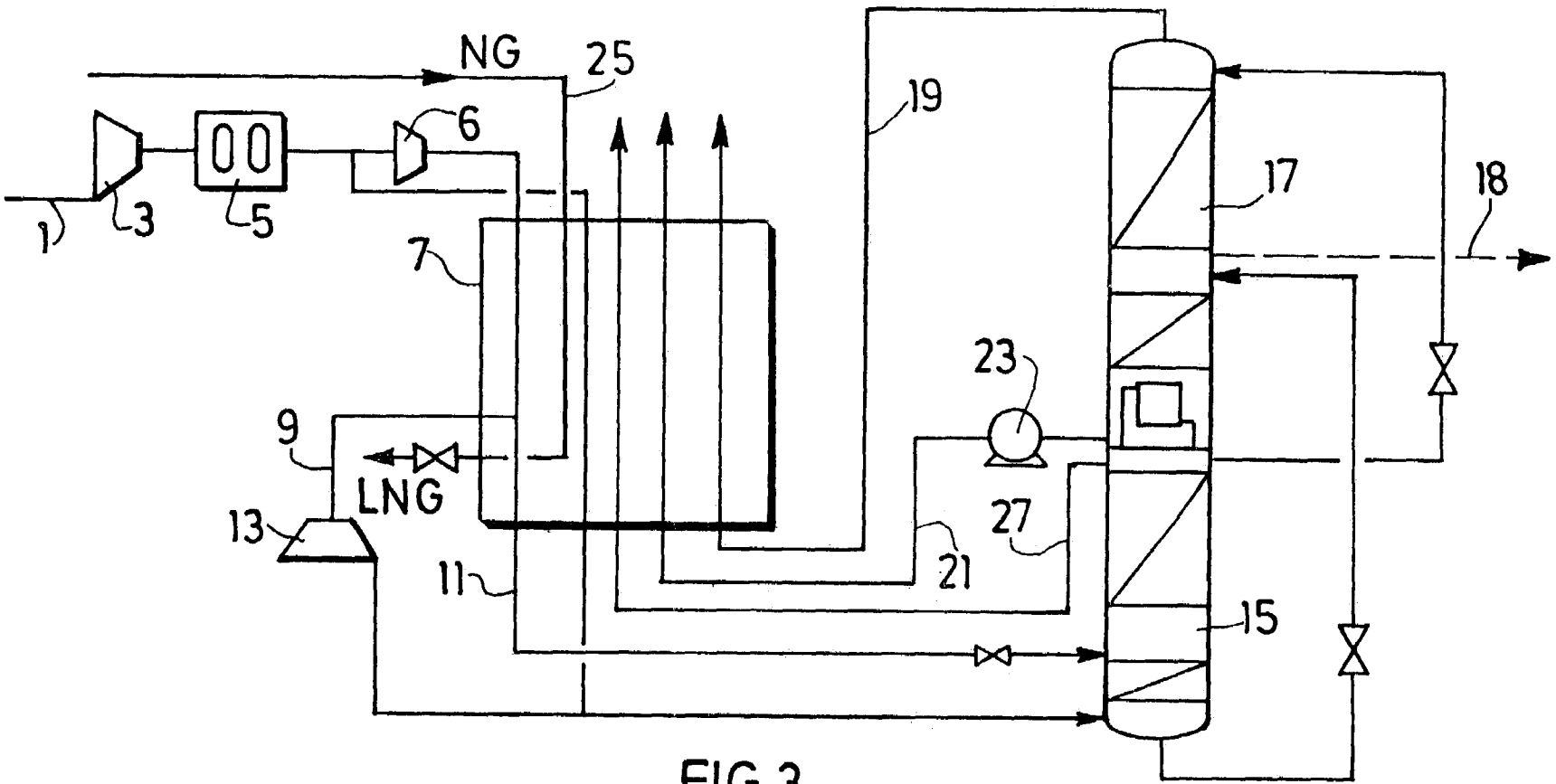

Large liquid production in the installation of FIG. 3. Air 1 is compressed to a medium pressure in compressor 3 (5.4 bar) and is cooled through the use of a mechanical refrigeration unit or an absorption refrigeration unit to a temperature of 12° C. Air is then purified through adsorbers 5 containing typically alumina and molecular sieve and impurities like water and $CO_2$are removed. Air (base=1000 $Nm^3/h$) is then mixed with recycled air 31 (flow 364 $Nm^3/h$) and further compressed to a pressure of 70 bar abs. in booster 6, cooled and then introduced in an heat exchanger 7 typically of the plate-fin brazed aluminium type (alternately of the spiral wound exchanger type) and is cooled to a temperature of −36° C. and split in two streams 9, 11: first stream 9 (1014 $Nm^3/h$) is expanded through an expansion turbine 13 to a pressure of 5.6 bar abs., a temperature of −149.8° C. and split in two substreams 31, 33: one 33 is introduced in the medium pressure column 15 and one 31 is recycled in exchanger 7. Second stream 11 (350 $Nm^3/h$) is further cooled, condensed and subcooled to a temperature of −174.2° C. It is introduced in the medium pressure column 15. Oxygen enriched and nitrogen enriched streams are removed from the medium pressure column 15 and sent to the low pressure column 17. From this distillation column 17, a liquid oxygen enriched stream 21 (200 $Nm^3/h$) is removed and pumped to a pressure of 53.5 bar, two gaseous nitrogen enriched streams 19, 27 are also removed, one 19 at low pressure 1.25 bar and a temperature of −175.2° C. (this stream has been used to subcool streams internal to the distillation section; flow: 720 $Nm^3/h$), another 27 at medium pressure 5.5 bar and −177.8° C. (flow 80 $Nm^3/h$). Those three streams are warmed in the heat exchanger and oxygen is vaporised. A pre-treated natural gas stream 24 GN (from which Hg, $H_2S$, $H_2O$ and $CO_2$ have been removed) at a pressure of 60 bar abs. is precooled to a temperature of −38° C. (typically using a propane cycle as in U.S. Pat. No. 3,763,658) is introduced in the heat exchanger 7, with a flow of 280 $Nm^3/h$. Heavy hydrocarbons have been removed during this precooling phase. It is then introduced in the heat exchanger to be further cooled to a temperature around −165° C. and send to storage after expansion through a valve or a liquid turbine.

The table below shows the production of LNG and the power consumption for a GTL plant using 20000 t/day of oxygen.

| | LNG $10^6$ tons/yearMW | Power consumption |
|---|---|---|
| ASU alone (FIG. 6) | 0 | 339 |
| Minimal (FIG. 1) | 0.8 | 362 |
| Intermediate (FIG. 2) | 2.7 | 448 |
| Large (FIG. 3) | 5.7 | 562 |

When comparing minimal LNG production to ASU alone, the air separation unit is much simpler: a single air compressor compared to an air compressor and a booster air compressor, a precooling system and a purification unit operating at a higher pressure allowing a significant reduction in size of those equipment thanks to the smaller volume flow and to a better efficiency of adsorption. Therefore, this minimal liquid production is made available for a negative investment.

Figure 4:
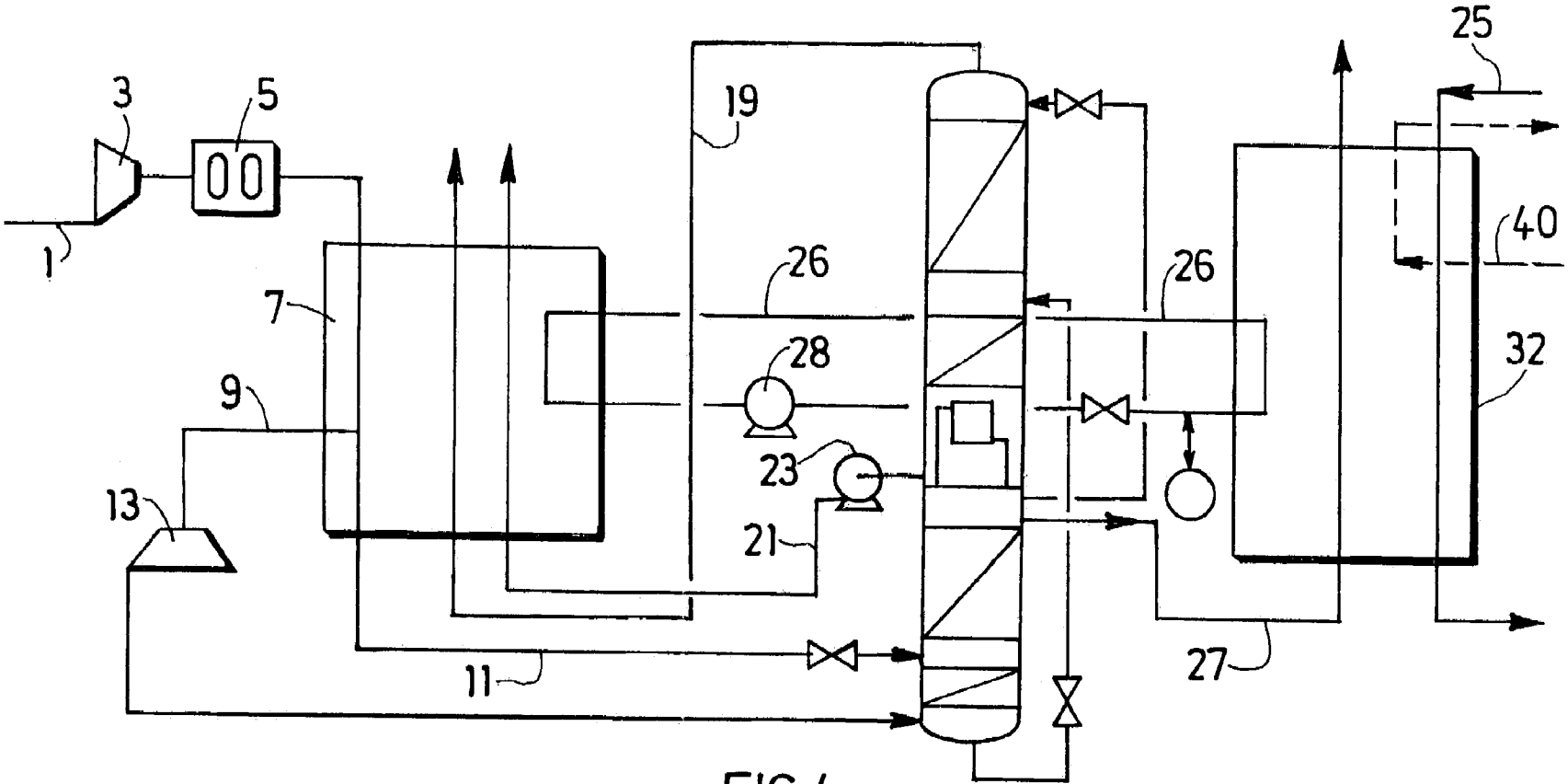

Alternatively a process as shown in FIG. 4 may be used. The advantage of this solution is that the natural gas is in indirect heat exchange only with inert gases.

In this case air 1 is compressed in a main air compressor 3 to a pressure of 21.5 bar and is cooled through the use of a mechanical refrigeration unit or an absorption refrigeration unit to a temperature of 12° C. Air 1 is then purified through adsorbers 5 containing typically alumina and molecular sieve and impurities like water and $CO_2$ are removed. Air 1 (base=1000 $Nm^3/h$) is then introduced in a main heat exchanger 7 typically of the plate-fin brazed aluminium type (alternately a spiral wound exchanger may be used) and is cooled to a temperature of −145° C. and split in two streams 9, 11: first stream 9 (848 $Nm^3/h$) is expanded through an expansion turbine 13 to a pressure of 5.6 bar, a temperature of −173.5° C. and a liquid fraction of more than 10 mol %. Second stream 11 (152 $Nm^3/h$) is further cooled, condensed and subcooled to a temperature of −174.8° C. Both streams are introduced into the medium pressure column 15 of the cryogenic air separation plant, but at different levels. Oxygen enriched and nitrogen enriched liquid streams are removed from the medium pressure column 15 and sent to the low pressure column 17. Nitrogen enriched gaseous stream 27 (flow: 80 $Nm^3/h$) is also removed from this column. From this distillation column 17, a liquid oxygen enriched stream 21 (200 $Nm^3/h$) is removed and pumped by pump 23 to a pressure of 53.5 bar, a gaseous nitrogen enriched streams 19 is also removed from the low pressure column 17 at low pressure 1.25 bar abs. and a temperature of −176° C. (this stream has been used to subcool streams internal to the distillation section; flow: 720 $Nm^3/h$). Those two streams 19, 21 are warmed in the heat exchanger 7.

A pre-treated natural gas stream GN 25 (from which Hg, $H_2S$, $H_2O$ and $CO_2$ have been removed) at a pressure of 60 bar abs. and a temperature dose to ambient is introduced into an additional heat exchanger 32 with a flow of 38 $Nm^3/h$. If stream 25 contains heavy hydrocarbons, it can be removed at an intermediate temperature of the additional exchanger 32 to remove those heavy hydrocarbons as shown in U.S. Pat. No. 5,390,499 and then reintroduced in the additional heat exchanger 32 to be further cooled to a temperature of around −165° C. and sent to storage after expansion through a valve or a liquid turbine as flow GNL. In the additional heat exchanger 32, the natural gas exchanges heat with nitrogen enriched gaseous stream 27 and a fluid flowing in a dosed circuit 26. The fluid in this circuit is typically an inert gas such as argon, nitrogen, CF4, HCF3 or any other refrigerant. It is heated in exchanger 32 where it is at least partially vaporised (or pseudo-vaporised if above supercritical pressure) and cooled down in exchanger 7 where it is at least partially condensed (or pseudo-condensed if above supercritical pressure). The liquefied natural gas is removed from the heat exchanger 32.

Figure 5:
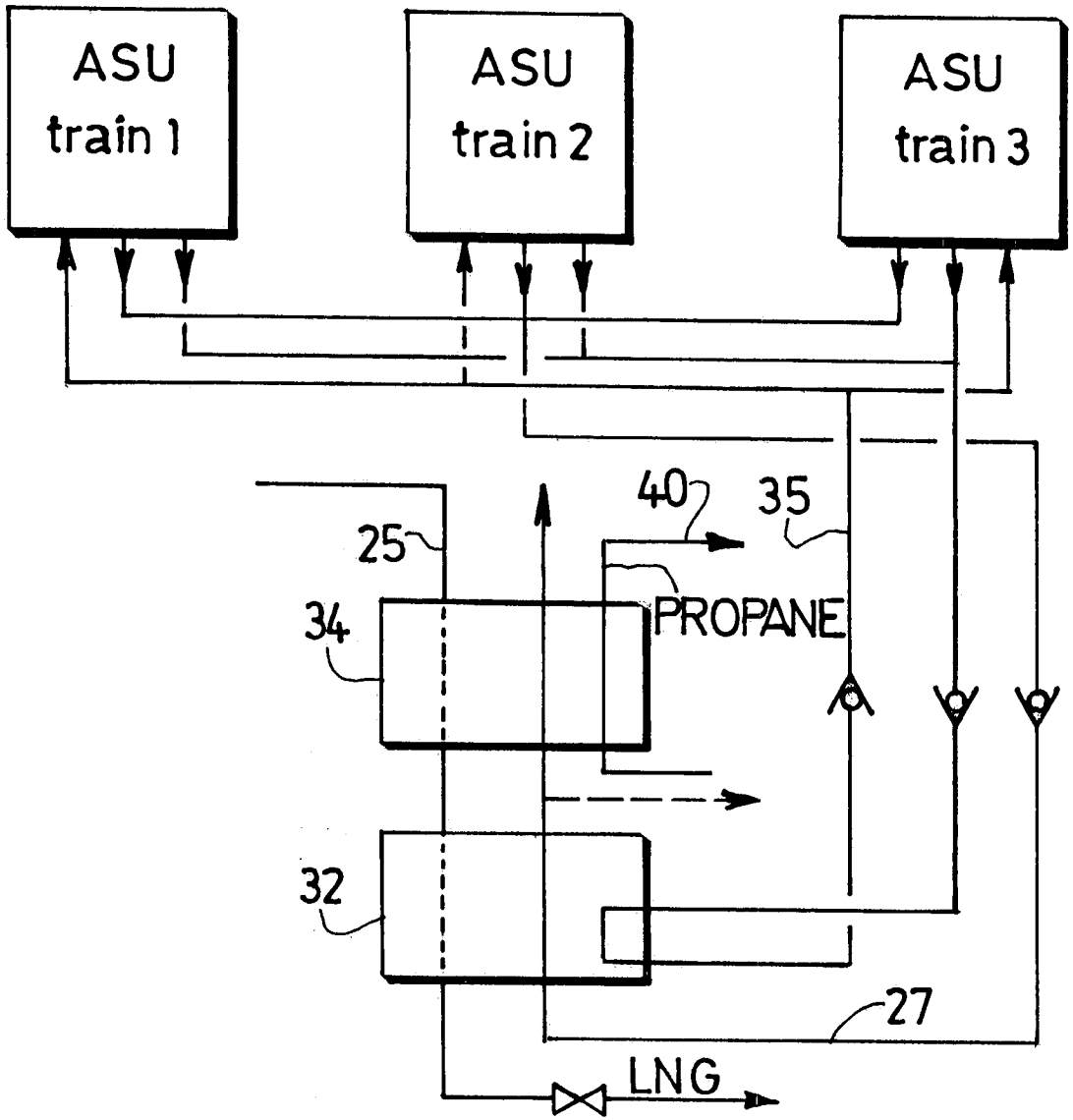

A 20,000 ton/day (7.3 million tons per year) oxygen air separation unit cannot be built today in a single train essentially due to size limitations for the columns. Typically 3 to 5 trains are required. On the contrary, it is possible to built a single liquefaction train for a size of 14,000 ton/day (5 million tons per year). Therefore, an optimisation of the solution of FIGS. 1 to 4 in terms of architecture of the whole plant could consist in sending one (or several) cold fluid(s) (typically nitrogen enriched fluid either liquid or vapor) from each of the air separation trains to the single natural gas liquefaction train (see FIG. 5 in which three trains are used, ASU train 1, ASU train 2 and ASU train 3) rather than to send a natural gas stream to each of the air separation trains. Similarly to the process of FIG. 4, nitrogen 27 is removed from all three trains (or at least one of the trains), mixed to from a single stream arid sent to a first heat exchanger and then a second heat exchanger. Circuit fluid 26 is cooled in the heat exchanger 7 of each train, mixed to form a single stream and then sent to heat exchanger 32 where it is warmed before being separated and sent back to the trains. Natural gas 25 is pre-cooled in the exchanger 34 against a propane and the nitrogen 27. Propane will be typically vaporised at different levels of pressure. Alternately, a mixed refrigerant cycle could be used to perform this precooling. Thereafter in exchanger 32 natural gas is cooled against the nitrogen 27 and the inert gas 26 in the circuit.

Another optimisation results from the fact that an air separation unit where oxygen is vaporised between 30 and 60 bar can provide cold at very low level of temperature (130° C. to −110° C.). Therefore it is possible to condense natural gas (depending on its composition) at low pressures between 10 and 20 bar abs. Two options are then available:

1st if natural gas is available on site at pressures between 40 and 60 bar abs. It is possible to expand this natural gas sentropically either from ambient temperature or after propane recooling (preferred solution); when applying this optimisation to FIGS. 1 and 2, LNG production becomes respectively 1.0 Mt/y and 3.1 Mt/y, power consumption respectively 361 MW and 441 MW; or 2nd reduce the number and/or the power consumption of the compressors which send the natural gas on site.

In FIGS. 1 to 3, stream 27 can be omitted. In FIG. 4, part of stream 19 could replace stream 27.

In all the Figures, it is possible to produce argon in classical fashion using stream 18. It is also possible to send part of stream 11 to low pressure column. Moreover, liquids extracted from medium pressure column can be cooled down by indirect heat exchange with stream 19 prior to expand them in a valve and introduce them in the low pressure column. It is also possible to replace the expansion valves on stream 11 and on LNG by liquid turbines. If any of the compressor is driven by a gas turbine it is also possible to extract air from this gas turbine to feed at least partially the air separation unit(s).

Figure 6:
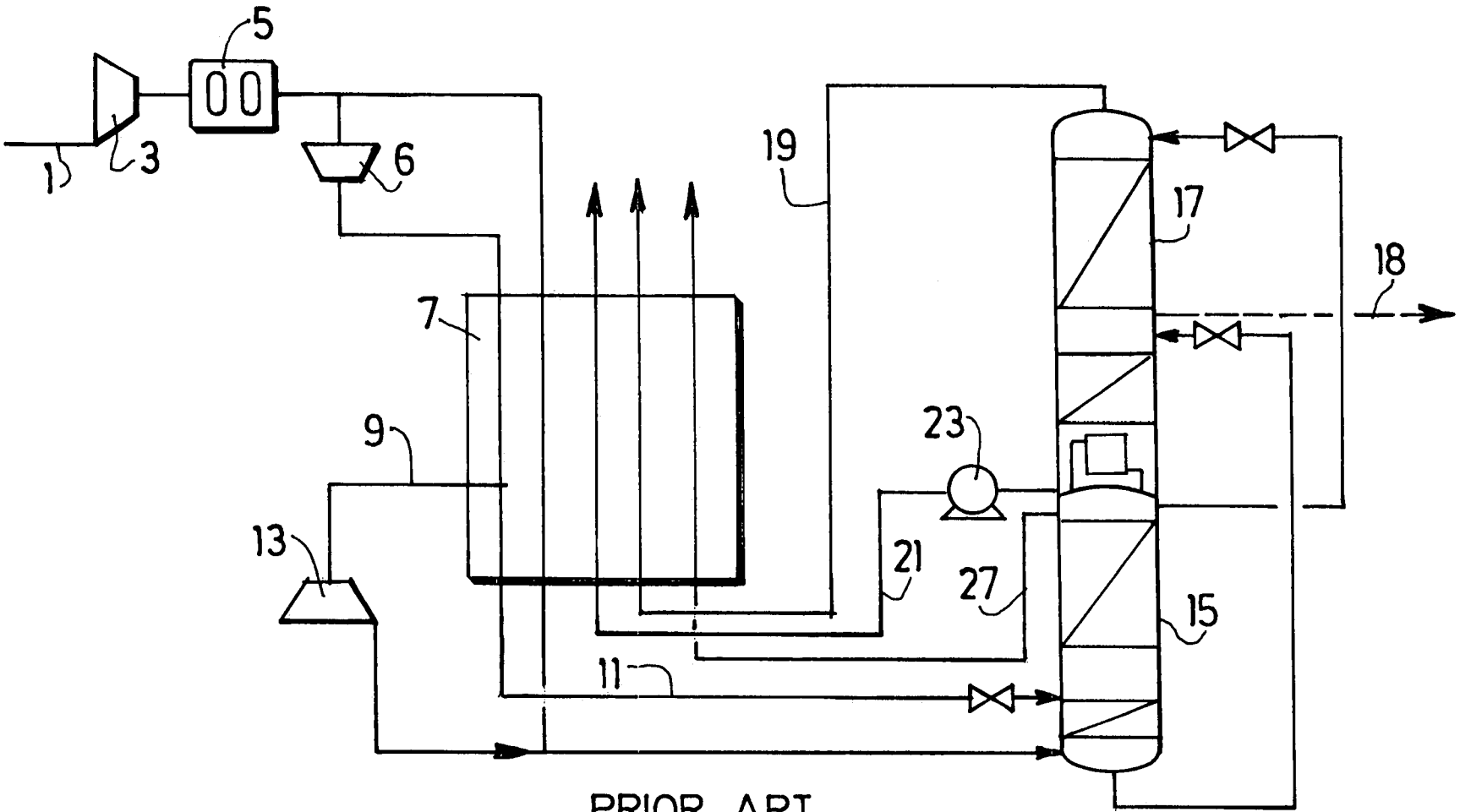
PRIOR ART FIG. 6
FIG. 6 shows the prior art.

FIG. 6 shows an air separation unit as known from the prior art without any natural gas liquefaction.

Air 1 is compressed to a medium pressure in compressor 3 (5.8 bar) and is cooled through the use of a mechanical refrigeration unit or an absorption refrigeration unit to a temperature of 12° C. Air is then purified through adsorbers 5 containing typically alumina and molecular sieves and impurities like water and $CO_2$ are removed. Air (base=1000 $Nm^3/h$) is then divided in 2 streams. First air stream (flow 455 $Nm^3/h$) is further compressed to a pressure of 66 bar abs. in booster 6, cooled and then introduced in an heat exchanger 7 typically of the plate-fin brazed aluminium type (alternately of the spiral wound exchanger type) and is cooled to a temperature of −98° C. and split in two sub-streams 9, 11: first stream 9 (65 $Nm^3/h$) is expanded through an expansion turbine 13 to a pressure of 5.6 bar abs., a temperature of −173.4° C. and introduced in the medium pressure column 15. Second substream 11 (390 $Nm^3/h$) is further cooled, condensed and subcooled to a temperature of −168.2° C. It is introduced in the medium pressure column 15. Second air stream (flow 545 $Nm^3/h$) is cooled in an heat exchanger 7 and also introduced in medium pressure column. Oxygen enriched and nitrogen enriched streams are removed from the medium pressure column 15 and sent to the low pressure column 17. From this distillation column 17, a liquid oxygen enriched stream 21 (200 $Nm^3/h$) is removed and pumped to a pressure of 53.5 bar, two gaseous nitrogen enriched streams 19, 27 are also removed, one 19 at low pressure 1.25 bar and a temperature of −175.2° C. (this stream has been used to subcool streams internal to the distillation section; flow: 720 $Nm^3/h$), another 27 at medium pressure 5.5 bar and −177.8° C. (flow 80 $Nm^3/h$). Those three streams are warmed in the heat exchanger and oxygen is vaporised.

Although the invention has been described in detail with reference to certain preferred embodiments, those skilled in the art will recognize that there are other embodiments of the invention within the spirit and the scope of the claims. In particular, any precooling cycle already described for natural gas liquefaction could be used and any air separation unit cycle with isentropic expansion could be used to provide refrigeration to liquefy natural gas.

What is claimed is:

1. An integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger; wherein the natural gas is liquefied within the main heat exchanger of the cryogenic air distillation plant, in which feed air for the cryogenic air distillation plant is cooled to a temperature suitable for distillation and the cold fluid is at least one liquid stream, enriched in at least one of oxygen, nitrogen and argon with respect to air, which vaporises in the main heat exchanger; wherein all the air to be separated in the cryogenic air distillation plant is cooled in the main heat exchanger, and wherein the natural gas is liquefied by heat exchange in an additional heat exchanger other than the main heat exchanger with at least one cold fluid which has previously been cooled by a vaporising liquid in the main heat exchanger of at least one air distillation plant.

2. The process according to claim 1, wherein the natural gas is liquefied by means of a closed circuit in which a cold fluid flows, said cold fluid being warmed by heat exchange with the liquefying vaporising natural gas and cooled by heat exchange in the main heat exchanger.

3. The process according to claim 1, wherein the cold fluid is chosen from the group comprising nitrogen, argon, CF4, HCF3, methane, ethane, ethylene and propane.

4. The process according to claim 1, wherein gaseous nitrogen from the cryogenic air distillation plant is sent to the additional heat exchanger.

5. An integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger wherein all of the refrigeration required to liquefy the natural gas is derived from a single cryogenic air distillation plant, the columns of the plant, the main heat exchanger and the further heat exchanger being situated within a single cold box.

6. An integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger wherein part of the refrigeration required to liquefy the natural gas is derived from at least two cryogenic air distillation plants, each comprising a main heat exchanger and distillation columns, said main heat exchanger and distillation columns being within the cold box, the part of the refrigeration required to liquefy the natural gas being produced by vaporisation of at least one liquid stream, enriched in oxygen, nitrogen or argon, produced by one of the distillation columns, and the natural gas liquefies by heat exchange in a further heat exchanger by heat exchange with a cold fluid removed from each cryogenic air distillation plant.

7. An integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger wherein the natural gas prior to undergoing indirect heat exchange with said cold fluid is at least partially precooled at a temperature below 0° C. by indirect heat exchange with at least one fluid not derived from any cryogenic air distillation plant.

8. The process according to claim 7, wherein said fluid(s) not derived from any cryogenic air distillation plant comprises propane.

9. An integrated process for the separation of air by cryogenic distillation and liquefaction of natural gas in which at least part of the refrigeration required to liquefy the natural gas is derived from at least one cryogenic air distillation plant comprising a main heat exchanger and distillation columns, wherein the natural gas liquefies by indirect heat exchange in a heat exchanger with a cold fluid, the cold fluid being sent to the heat exchanger at least partially in liquid form and undergoing at least a partial vaporization in the heat exchanger; wherein the natural gas is liquefied within the main heat exchanger of a/the cryogenic air distillation plant, in which feed air for the cryogenic air distillation plant is cooled to a temperature suitable for distillation and the cold fluid is at least one liquid stream, enriched in at least one of oxygen, nitrogen and argon with respect to air, which vaporises in the main heat exchanger; wherein all the air to be separated in the cryogenic air distillation plant is cooled in the main heat exchanger; comprising an additional heat exchanger other than the main heat exchanger and means for sending the natural gas to be liquefied and at least one cold fluid which has previously been cooled by a vaporising liquid in the main heat exchanger of at least one air distillation plant to the additional heat exchanger.

10. The apparatus according to claim 9 comprising a closed circuit passing through the main and additional heat exchangers in which the at least one cold fluid flows.

11. The apparatus according to claim 9 comprising means for sending gaseous nitrogen from the at least one cryogenic air distillation plant to the additional heat exchanger.

12. Integrated apparatus for the separation of air by cryogenic distillation and liquefaction of natural gas in which at least part of the refrigeration required to liquefy the natural gas is derived from at least one cryogenic air distillation plant comprising a main heat exchanger and distillation columns, comprising means for sending natural gas and a cold fluid at least partially in liquid form to a heat exchanger, means for removing liquefied natural gas from the heat exchanger and means for removing at least partially vaporised cold fluid from the heat exchanger; wherein all of the refrigeration required to liquefy the natural gas is derived from a single cryogenic air distillation plant, the columns of the plant, the main heat exchanger and the further heat exchanger being situated within a single cold box.

13. Integrated apparatus for the separation of air by cryogenic distillation and liquefaction of natural gas in which at least part of the refrigeration required to liquefy the natural gas is derived from at least one cryogenic air distillation plant comprising a main heat exchanger and distillation columns, comprising means for sending natural gas and a cold fluid at least partially in liquid form to a heat exchanger, means for removing liquefied natural gas from the heat exchanger and means for removing at least partially vaporised cold fluid from the heat exchanger; wherein part of the refrigeration required to liquefy the natural gas is derived from at least two cryogenic air distillation plants, each comprising a main heat exchanger and distillation columns, said main heat exchanger and distillation columns being within the cold box, the part of the refrigeration required to liquefy the natural gas being produced by vaporisation of at least one liquid stream, enriched in oxygen, nitrogen or argon, produced by one of the distillation columns, and the natural gas liquefies by heat exchange in a further heat exchanger by heat exchange with a cold fluid removed from each cryogenic air distillation plant.

14. Integrated apparatus for the separation of air by cryogenic distillation and liquefaction of natural gas in which at least part of the refrigeration required to liquefy the natural gas is derived from at least one cryogenic air distillation plant comprising a main heat exchanger and distillation columns, comprising means for sending natural gas and a cold fluid at least partially in liquid form to a heat exchanger, means for removing liquefied natural gas from the heat exchanger and means for removing at least partially vaporised cold fluid from the heat exchanger; comprising means for precooling the natural gas prior to undergoing indirect heat exchange with said cold fluid.

15. The apparatus according to claim 14 wherein said means for precooling comprises a heat exchanger and means for sending propane to the heat exchanger.

16. An integrated process for the separation of air by cryogenic distillation and liquefaction of natural gas (LNG) which comprises the steps of:

i. providing at least part of the refrigeration from at least one cryogenic air distillation plant;

ii. liquefying the natural gas by indirect heat exchange in a heat exchanger with a cold fluid, and wherein said air distillation plant comprises:

i. a main heat exchanger; and ii. at least one distillation column; wherein an additional heat exchanger liquefies the natural gas with at least one pre-cooled fluid from the main heat exchanger.

17. The process according to claim 16, wherein the process of the main heat exchanger comprises the steps of:

i. flowing cold fluid within a closed circuit;

ii. cooling said fluid; and iii. warming said fluid by heat exchange with the liquefying vaporizing natural gas.

18. The process according to claim 16, wherein said cold fluid comprises at least one component selected from the group consisting of nitrogen, argon, CF4, HCF3, methane, ethane, ethylene and propane.

19. An integrated process for the separation of air by cryogenic distillation and liquefaction of natural gas (LNG) which comprises the steps of:

i. providing at least part of the refrigeration from at least one cryogenic air distillation plant;

ii. liquefying the natural gas by indirect heat exchange in a heat exchanger with a cold fluid, iii. cooling the feed air to a temperature suitable for distillation; and iv. vaporizing the cold fluid that comprises a liquid stream enriched in at least one component selected from the group consisting of oxygen, nitrogen and argon, and wherein said air distillation plant comprises:

i. a main heat exchanger; and ii. at least one distillation column; wherein gaseous nitrogen is sent from the cryogenic air distillation plant to the additional heat exchanger.

20. An integrated process for the separation of air by cryogenic distillation and liquefaction of natural gas (LNG) which comprises the steps of:

i. providing at least part of the refrigeration from at least one cryogenic air distillation plant;

ii. liquefying the natural gas by indirect heat exchange in a heat exchanger with a cold fluid, and wherein said air distillation plant comprises:

i. a main heat exchanger; and ii. at least one distillation column; wherein part of the refrigeration required to liquefy the natural gas is derived from at least two cryogenic air distillation plants, wherein each plant comprises:

i. main heat exchanger;

ii. at least one distillation column; and iii. additional heat exchanger, wherein said main heat exchanger provides at least part of the refrigeration required to liquefy the natural gas by the vaporization of at least one liquid stream, enriched in oxygen, nitrogen or argon, produced by one of the distillation columns, and wherein said additional heat exchanger provides at least another part of the refrigeration by exchanging heat with a cold fluid removed from each cryogenic air distillation plant, whereby liquefying the natural gas.

21. An integrated process for the separation of air by cryogenic distillation and liquefaction of natural gas (LNG) which comprises the steps of:

i. providing at least part of the refrigeration from at least one cryogenic air distillation plant;

ii. liquefying the natural gas by indirect heat exchange in a heat exchanger with a cold fluid, and wherein said air distillation plant comprises:

i. a main heat exchanger; and ii. at least one distillation column; wherein the natural gas prior to undergoing indirect heat exchange with said cold fluid is at least partially precooled to a temperature below 0° C. by indirect heat exchange with at least one fluid not derived from any cryogenic air distillation plant.

22. The process according to claim 21, wherein said fluid comprises propane.

23. An integrated apparatus for the separation of air by cryogenic distillation and liquefaction of natural gas which comprises:

i. at least one cryogenic air distillation plant that provides part of the refrigeration; and ii. a heat exchanger with a cold fluid that liquefies natural gas by indirect heat exchange; wherein iii. the apparatus comprises means for sending the natural gas to be liquefied to the main heat exchanger of the cryogenic air distillation plant; and iv. the cold fluid is at least one liquid stream, enriched in at least one component selected from the group consisting of oxygen, nitrogen and argon.

24. An integrated apparatus for the separation of air by cryogenic distillation and liquefaction of natural gas which comprises:

i. at least one cryogenic air distillation plant that provides part of the refrigeration; and ii. a heat exchanger with a cold fluid that liquefies natural gas by indirect heat exchange; wherein said apparatus further comprises an additional heat exchanger which receives the natural gas to be liquefied and at least one pre-cooled fluid from the main heat exchanger.

25. The apparatus according to claim 24, wherein said main and additional heat exchangers contain a closed circuit that permits at least one cold fluid to flow.

26. The apparatus according to claim 24, wherein said apparatus provides a means for sending gaseous nitrogen from at least one cryogenic air distillation plant to the additional heat exchanger.

27. An integrated apparatus for the separation of air by cryogenic distillation and liquefaction of natural gas which comprises:

i. at least one cryogenic air distillation plant that provides part of the refrigeration; and ii. a heat exchanger with a cold fluid that liquefies natural gas by indirect heat exchange; wherein the apparatus provides the means for natural gas to be pre-cooled prior to undergoing indirect heat exchange with said cold fluid.

28. An integrated apparatus for the separation of air by cryogenic distillation and liquefaction of natural gas which comprises:

i. at least one cryogenic air distillation plant that provides part of the refrigeration; and ii. a heat exchanger with a cold fluid that liquefies natural gas by indirect heat exchange; wherein said heat exchanger provides a means for precooling and sending propane to the heat exchanger.

* * * * *